United States Patent [19]

Fritz et al.

[11] Patent Number: 4,975,000

[45] Date of Patent: Dec. 4, 1990

[54] RAILROAD HOPPER CAR OUTLET GATE END TUBE ASSEMBLIES

[75] Inventors: William E. Fritz, Naperville; James C. Pankow, Geneva, both of Ill.

[73] Assignee: Gen-Tech, Inc., North Aurora, Ill.

[21] Appl. No.: 440,083

[22] Filed: Nov. 22, 1989

[51] Int. Cl.[5] ..... B65G 53/24; B65G 53/50

[52] U.S. Cl. ..... 406/145; 406/128

[58] Field of Search ..... 406/128, 145

[56] References Cited

U.S. PATENT DOCUMENTS

| | | | |
|---|---|---|---|
| 3,079,032 | 2/1963 | Dorey | 406/145 |
| 3,572,844 | 3/1971 | Mundings et al. | 406/145 |
| 4,312,607 | 1/1982 | Van Auken | 406/128 |
| 4,411,560 | 10/1983 | McComb | 406/145 |

*Primary Examiner*—Joseph F. Peters, Jr.
*Assistant Examiner*—Linda L. Palomar
*Attorney, Agent, or Firm*—Kinzer, Plyer, Dorn, McEachran & Jambor

[57] ABSTRACT

An end tube assembly for the outlet gate of a railroad hopper car includes an end tube and an end tube cap for closing the end tube. The cap is pivotally connected to the end tube and there is a diametrically opposed latch between the cap and end tube. The cap has a guide which extends toward and over the end tube and there is a ramp on the end tube in alignment with the guide to coaxially direct the guide and cap on the end tube during closure. There is a lock on the end tube adjacent the ramp to prevent relative circumferential movement between the cap and end tube. The end tube mounts a gasket which faces the end tube cap. The cap has a rim extending outwardly therefrom for contact with the gasket. The extension of the rim gradually varies from at least one area of greatest extent to at least one area of lesser extent to compensate for distortion of the cap when it is latched onto the end tube.

10 Claims, 4 Drawing Sheets

Fig. 2.
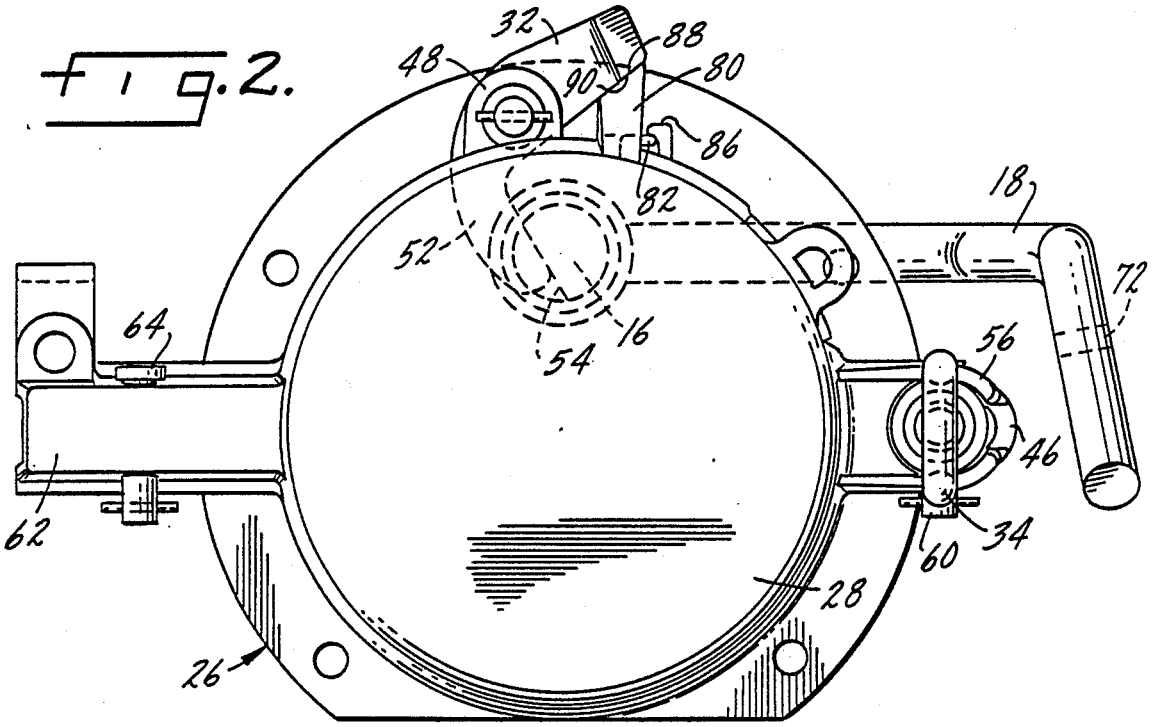
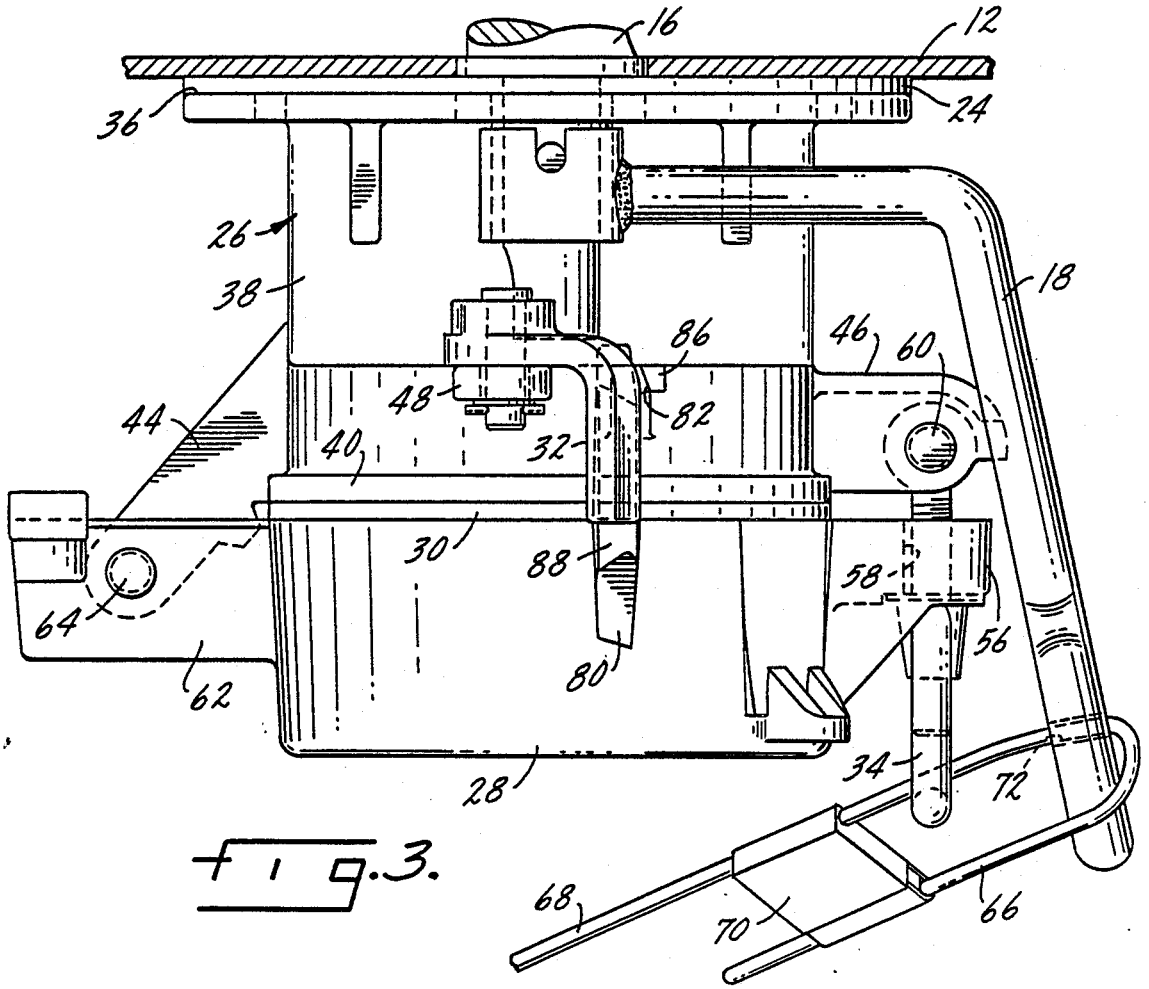
Fig. 3.

Fig. 4.
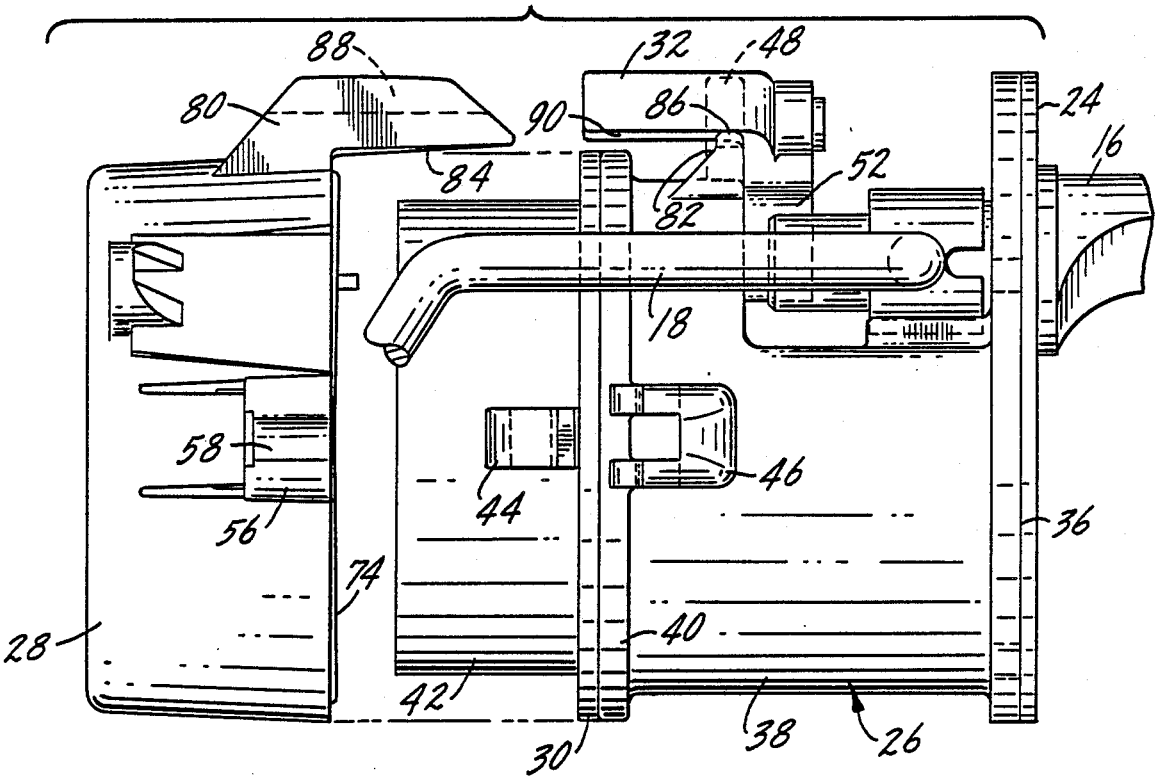
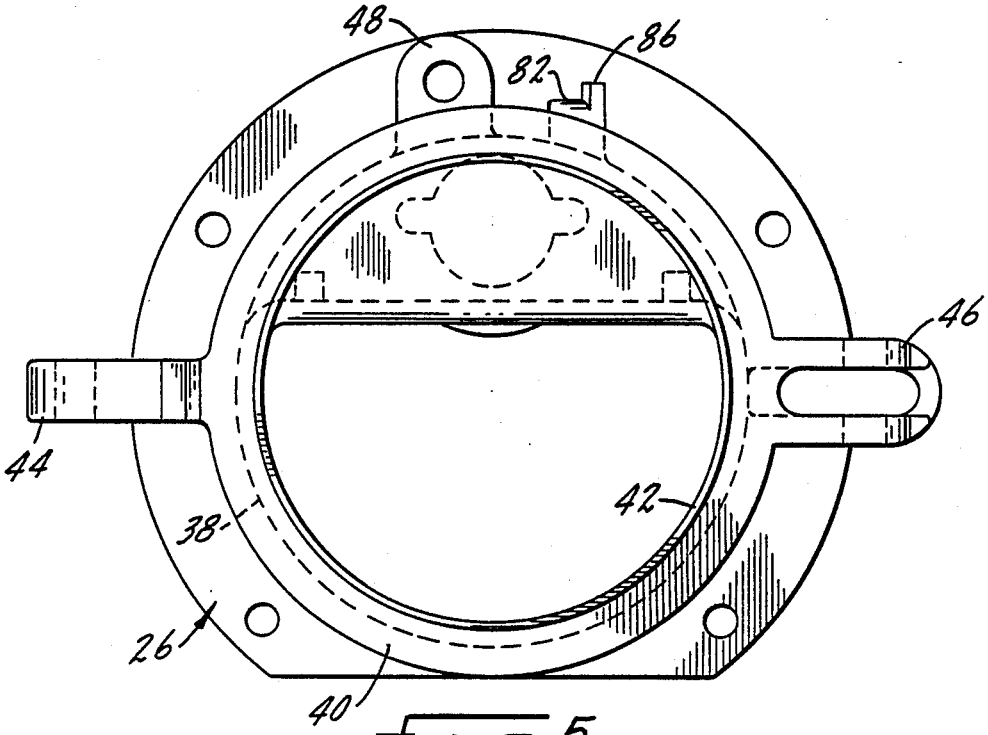
Fig. 5.

Fig. 6.
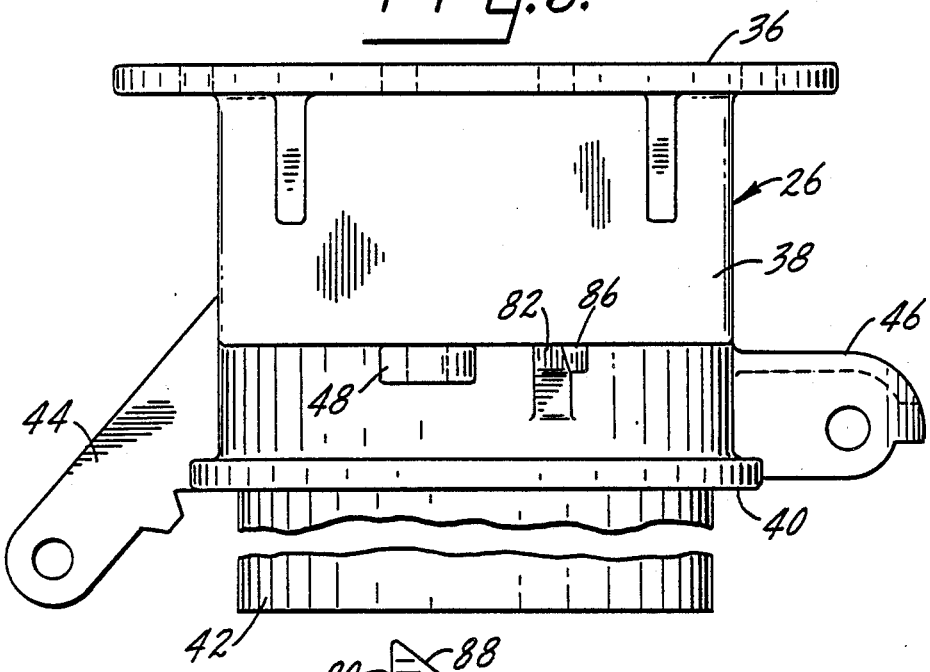
Fig. 7.
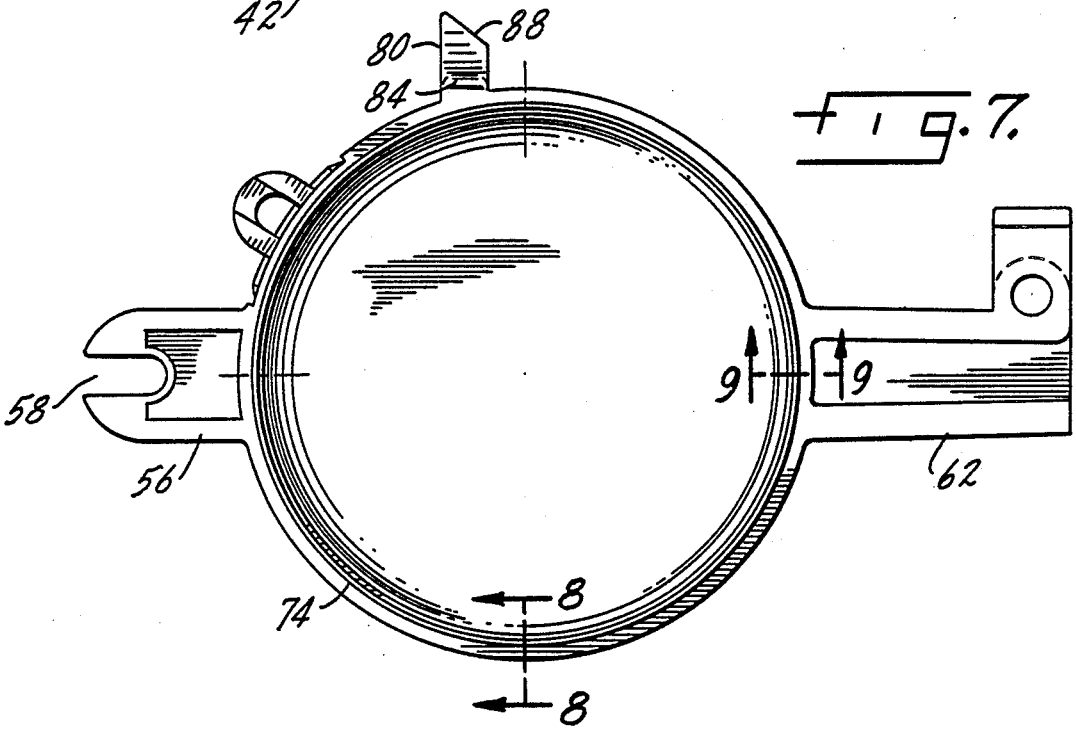
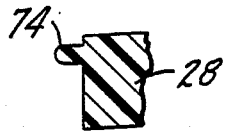
Fig. 8.
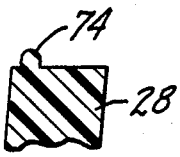
Fig. 9.

RAILROAD HOPPER CAR OUTLET GATE END TUBE ASSEMBLIES

SUMMARY OF THE INVENTION

The present invention relates to the outlet gate of a railroad hopper car and in particular to improvements in the end tube assembly for the outlet gate.

A primary purpose of the invention is an end tube assembly utilizing a non-metallic end tube cap and improvements in the cap to ensure that it is properly seated and sealed to the end tube.

Another purpose is an end tube assembly in which the end tube cap has a guide which cooperates with a ramp and lock on the end tube to properly align, position and lock the end tube cap on the end tube.

Another purpose is an end tube assembly of the type described in which the end tube cap guide not only aligns the cap on the end tube, but also latches the outlet gate shaft lock in position when the cap is closed.

Another purpose is an end tube assembly of the type described in which the end tube cap has sealing rim of gradually varying extent which cooperates with a gasket on the end tube to seal the cap to the end tube, with the gradually varying extension of the sealing rim compensating for distortion of the cap when in the closed and latched position.

Other purposes will appear in the ensuing specification, drawings and claims.

BRIEF DESCRIPTION OF THE DRAWINGS

The invention is illustrated diagrammatically in the following drawings wherein:

FIG. 2 is a front view of the end tube assembly;

FIG. 3 is a top view of the end tube assembly;

FIG. 4 is a side view of the end tube assembly, with the cap separated from the end tube;

FIG. 5 is a front view of the end tube;

FIG. 6 is a top view of the end tube;

FIG. 7 is a rear view of the end tube cap, showing the cap interior;

FIG. 8 is a section along plane 8—8 of FIG. 7; and

FIG. 9 is a section along plane 9—9 of FIG. 7.

Description of the Preferred Embodiment

Figure 1:
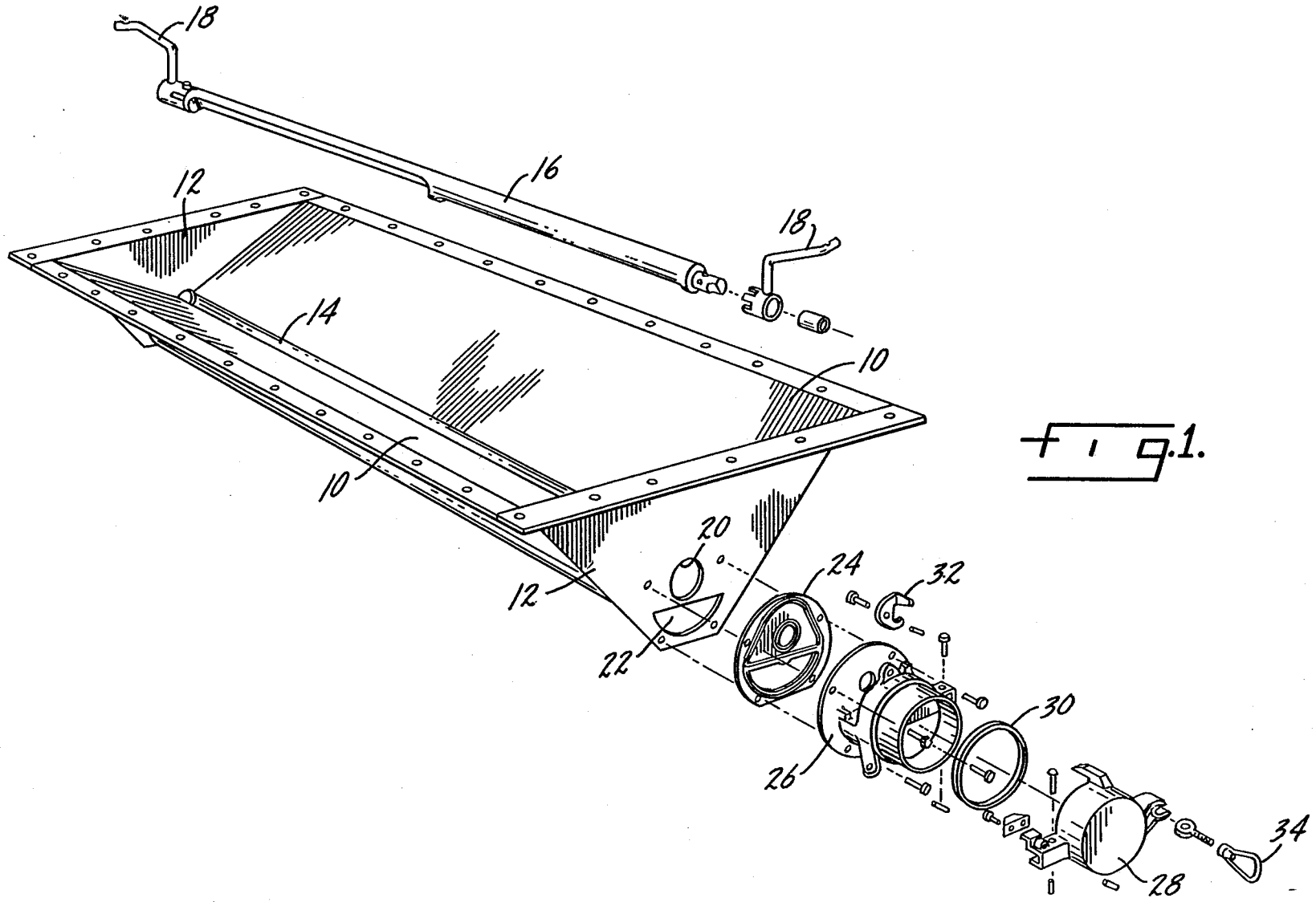
FIG. 1 is a perspective view, in exploded form, illustrating the parts of the outlet gate of a railroad hopper car.

FIG. 1 illustrates the various parts of the outlet gate which forms the discharge for a railroad hopper car. The gate includes slanted slope sheets 10 and end sheets or end plates 12 at opposite ends. There is a trough 14 which spans the space between the bottom edges of the slope sheets 10. The outlet gate has an identical discharge at each end and includes a shaft valve 16, operable from either end by handles 18. Shaft 16 extends through a shaft opening 20. There is a discharge opening 22 in each end plate. An end tube seal is indicated at 24 and is in contact with the end plate and has openings which are in alignment with shaft opening 20 and discharge opening 22. Positioned adjacent the end tube seal is the end tube 26 which has a cap 28 mounted thereto and a cap seal 30. There are various other parts to the end tube structure, including a shaft lock 32 and an eyebolt 34 which is used in locking shaft valve 16 in a predetermined position.

The end tube 26 includes a flat face 36 which bears against the end tube gasket 24. There is a cylindrical section 38 which terminates in a shoulder 40. A tube insert 42 extends outwardly from the end tube and is enclosed by cap 28 when the cap is in the closed position. A hinge member 44 extends outwardly from one side of end tube 26 and is used in pivotally mounting the cap to the end tube. A bracket 46 extends outwardly from a diametrically opposed point on the end tube and is used as a portion of the latch structure for the end tube cap. A mounting extension 48 extends outwardly from the end tube generally midway between member 44 bracket and 46 and pivotally mounts shaft lock 32. The shaft lock has a hook or lock portion 52, shown in FIGS. 2 and 4, which bears against a flatted surface 54 of shaft 16 to hold the shaft in a particular position. Shaft valve 16 is turned by handle 18 and shaft lock 32 is used to lock the shaft in any particular open or closed position.

End tube cap 28 has a bracket 56 with a slot 58, with the slot closing over the locking eyebolt 34 which forms the means whereby the cap is latched to the end tube. Eyebolt 34 is pivotally mounted by a bolt 60 to bracket 46, and when the cap is closed the slot extends about the eyebolt, with the head of the eyebolt being outside of the slot and being used to latch the cap to the end tube.

On the opposite side of the end tube cap from bracket 56 there is a further bracket 62 which cooperates with hinge member 44 and a pivot pin 64 to provide the pivotal mounting for the cap on the end tube. The end tube cap pivotal mounting and the latch for the end tube cap are on diametrically opposed portions of the end tube and cap.

A lock or seal for handle 18 and eyebolt 34, and thus the end tube cap, is indicated at 66 in FIG. 3 and includes a wire cable 68 which extends through a locking device 70 and then loops through an opening 72 in handle 18 and the opening of the eyebolt.

The end tube cap 28 has a rim or bead 74 which extends toward ring gasket 30 mounted on shoulder 40 of the end tube. Rim 74 cooperates with the gasket to form a seal between the end tube cap and the end tube. The outward extension of rim 74 gradually varies and there are two areas of greater extension and two areas of lesser extension. As shown in FIGS. 7, 8 and 9, the areas of lesser extension, illustrated by the section of FIG. 9, are located adjacent to bracket 62 and bracket 56. The areas of greatest axial extent are located 90 degrees from the areas of lesser axial extent and are illustrated in FIG. 8. There are two areas of greater axial extension and they are diametrically opposed and they are 90 degrees from the pivotal connection and latching connection between the end tube and the end tube cap. The areas of lesser axial extension are in alignment with the pivotal connection and the latch between the end tube cap and the end tube.

Preferably, the end tube cap is made from plastic and it may have some flexibility. When the end tube cap is in the closed position and the latch is pulled tight, the cap may distort and such distortion may cause the rim to draw back from ring gasket 30 at points spaced about 90 degrees from the areas of the latch and the pivotal connection. By having the rim extend a greater axial extent in the areas 90 degrees from the latch and the pivotal connection, it is ensured that there will be a complete circumferential seal between the end tube and the end tube cap. The extension of the rim gradually varies from the low areas to the high areas and at no point is there a sharp or abrupt change in the profile of rim 74.

The end tube cap 28 has a guide 80 which extends toward the end tube and functions to coaxially align the end tube cap with the end tube and the tube insert as the cap is closed. Guide 80 cooperates with a ramp or cam surface 82 on the end tube which ramp is directly adjacent the pivotal mounting of the shaft lock. Guide 80 has an under cam surface 84 which cooperates with ramp 82 to cam or align or direct the cap into a proper coaxial position with the end tube when the ca is closed. In order to prevent relative circumferential movement between the cap and the end tube, there is a small lock 86 directly adjacent ramp 82. The lock extends radially outwardly beyond the termination of the ramp and the lower surface of guide 80 rests on the ramp when in the closed position, but cannot move clockwise relative to the end tube when the cap is closed because of the position of lock 86.

Guide 80 also has an upper cam surface 88 which bears against a portion of shaft lock 32, as shown particularly in FIG. 2. Thus, the guide not only functions to align the cap during closure, but also functions as a latch for the shaft lock. Cam surface 88 on guide 80 bears against a surface 90 on shaft lock 32 and holds the shaft lock in the latched position of FIG. 2 when the end tube cap is in a closed position on the end tube.

The present invention is particularly concerned with improvements in the end tube cap that are brought about because the cap may be made of a flexible material such as plastic, rather than a rigid material such as metal, as has been the practice in the past. A flexible cap is subject to distortion and for this reason, it is necessary to have a sealing rim of varying axial extent. Also, because the end tube cap is distortable, it is necessary to ramp it into a closing position and to lock it in that position once the cap is closed on the end tube. The guide on the end tube cap and the shaft lock cooperate to latch the shaft lock and also to prevent counterclockwise movement of the end tube cap relative to the end tube when the cap is closed.

Whereas the preferred form of the invention has been shown and described herein, it should be realized that there are many modifications, substitutions and alterations thereto.

We claim:

1. An end tube assembly for the outlet gate of a railroad hopper car including an end tube and an end tube cap for closing the end tube, a pivotal connection between the cap and end tube, a latch between the cap and end tube positioned generally diametrically opposite the pivotal connection, said cap having a guide which extends toward and over the end tube for aligning the cap during closure on the end tube, a ramp on said end tube in alignment with said guide to coaxially direct the guide and cap on the end tube during closure, and a lock on said end tube adjacent said ramp to prevent relative circumferential movement between said cap and end tube.

2. The end tube assembly of claim 1 further characterized in that a shaft lock is mounted on said end tube adjacent said ramp, said guide having a surface thereof which cams said shaft lock into a latched position when said cap is closed upon said end tube.

3. The end tube assembly of claim 2 further characterized in that said shaft lock cooperates with said guide to prevent relative circumferential movement between said cap and end tube in one direction and said lock prevents relative circumferential movement in the opposite direction between said cap and end tube.

4. The end tube assembly of claim 3 further characterized in that said guide has a surface facing the end tube which cooperates with the ramp to guide the cap on the end tube during closure, and an outwardly facing surface which cams the shaft lock into a latched position.

5. The end tube assembly of claim 1 further characterized in that said ramp and lock are generally equidistantly positioned between said pivotal connection and cap and end tube latch.

6. The end tube assembly of claim 1 further characterized by and including a gasket mounted on said end tube and facing said end tube cap, said cap having a rim extending outwardly therefrom toward and for contact with said gasket, the extension of said rim gradually varying from at least one portion of greater extent to at least one portion of lesser extent to compensate for distortion of said cap when it is latched onto said end tube.

7. An end tube assembly for the outlet gate of a railroad hopper car including an end tube and an end tube cap for closing the end tube, a pivotal connection between the cap and end tube, a latch between the cap and end tube located generally diametrically opposite the pivotal connection, said cap having a guide which extends toward and over the end tube for aligning the cap during closure on the end tube, a gasket mounted on said end tube and facing said end tube cap, said cap having a rim extending outwardly therefrom toward and for contact with said gasket, the extension of said rim gradually varying from at least one area of greater extension to at least one area of lesser extension to compensate for distortion of said cap when it is latched on said end tube.

8. The end tube assembly of claim 7 further characterized in that said ramp has two areas of greater extension and two areas of lesser extension, with the areas of greater extension being generally diametrically opposed.

9. The end tube assembly of claim 8 further characterized in that the areas of lesser rim extension are located at the cap and end tube pivotal connection and cap and end tube latch.

10. The end tube assembly of claim 8 further characterized in that the areas of greatest rim extension are located at the cap guide and generally diametrically opposite the cap guide.

* * * * *